United States Patent [19]

Grbavac et al.

[11] Patent Number: 5,033,911

[45] Date of Patent: Jul. 23, 1991

[54] BARRIER PLUG FOR A BORE

[75] Inventors: Roger Grbavac, Bethlehem, Pa.; Clifford A. McCartney, Salem, Va.

[73] Assignee: Ingersoll-Rand Company, Woodcliff Lake, N.J.

[21] Appl. No.: 510,925

[22] Filed: Apr. 19, 1990

[51] Int. Cl.[5] ..... F21D 20/02

[52] U.S. Cl. ..... 405/261; 405/260; 411/41

[58] Field of Search ..... 405/261, 260; 411/41, 411/40, 42; 52/704

[56] References Cited

U.S. PATENT DOCUMENTS

| | | | |
|---|---|---|---|
| Re. 25,869 | 10/1965 | Schuermann et al. | 405/261 |
| 3,877,235 | 4/1975 | Hill | 405/261 |
| 4,140,428 | 2/1979 | McLain et al. | 405/261 |

*Primary Examiner*—Dennis L. Taylor
*Attorney, Agent, or Firm*—Glenn B. Foster

[57] ABSTRACT

A barrier for use with a rod extending into a bore having a cross sectional dimension, formed in a structure. The barrier is located on one side of a fluid supply in the bore. The barrier includes a sealing portion adjacent the fluid supply, the sealing portion has a flexible flange in sealing contact with the bore. A tube is connected to the sealing portion and has a rod passageway formed there through. A diameter of the tubular portion is smaller than the cross sectional dimension prior to insertion of the rod, and expands to conform to the cross sectional dimension in response to insertion of the rod. A rupture portion is connected to the tubular portion, and seals the rod passageway to limit a passage of fluid therethrough prior to insertion of the rod. The rupture portion is adapted to rupture in response to penetration by the rod. The barrier may be used in conjunction with a dynamic earth anchor, to prevent passage of the grout to between the anchor and the bore.

20 Claims, 2 Drawing Sheets

FIG. 2
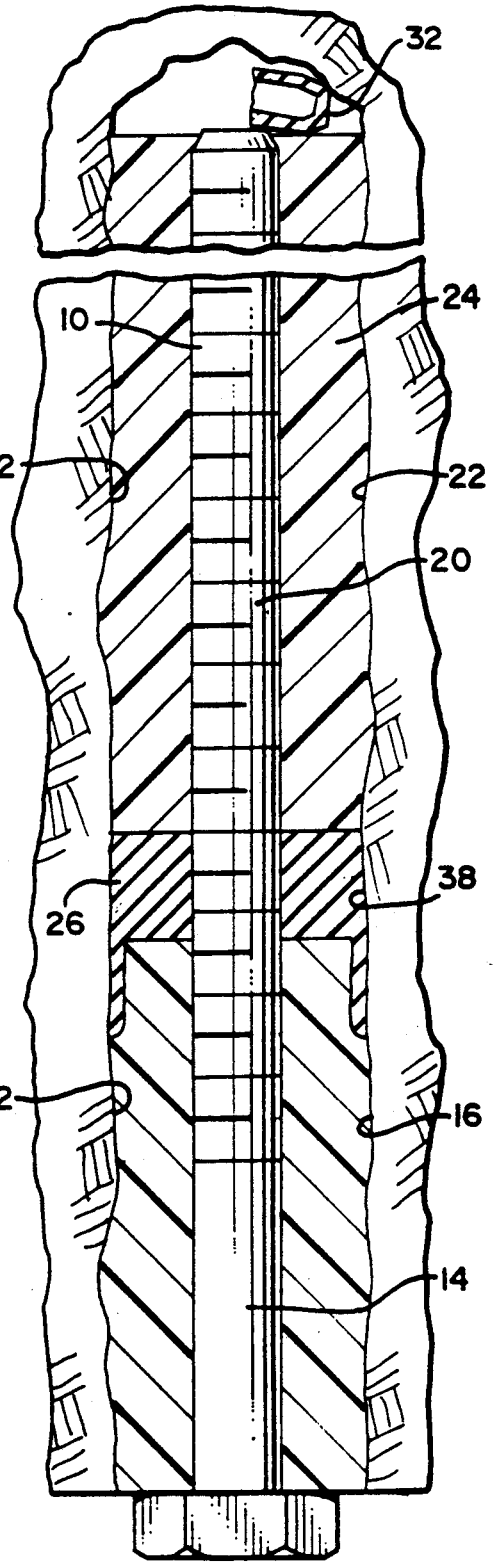
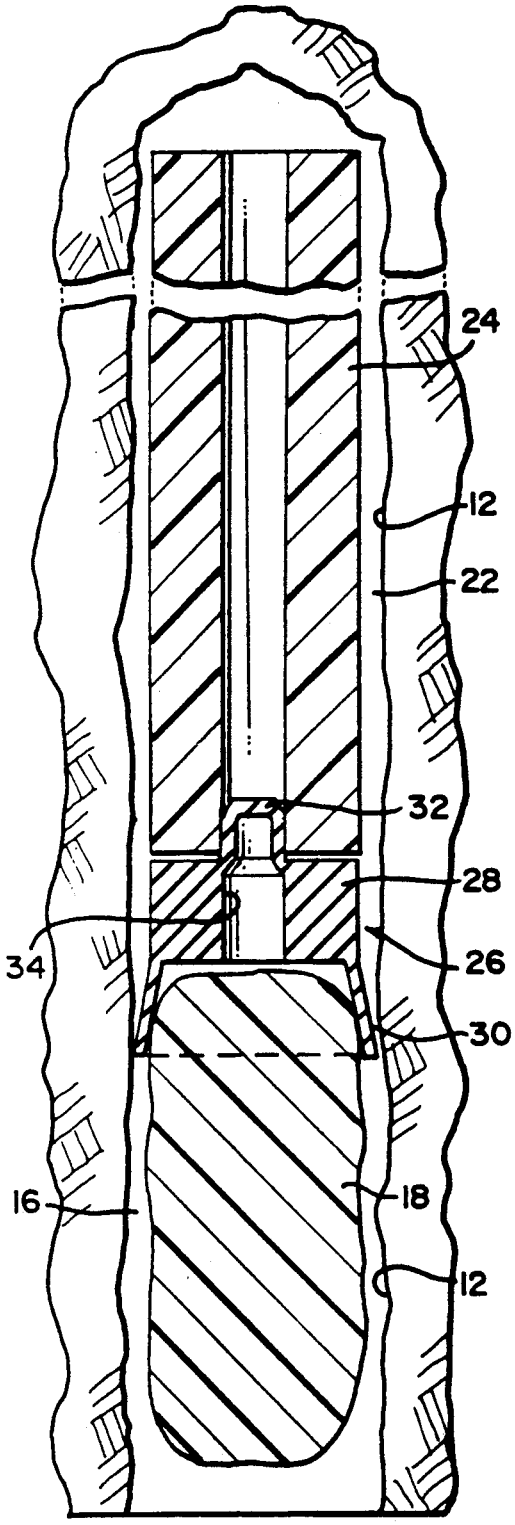
FIG. 1

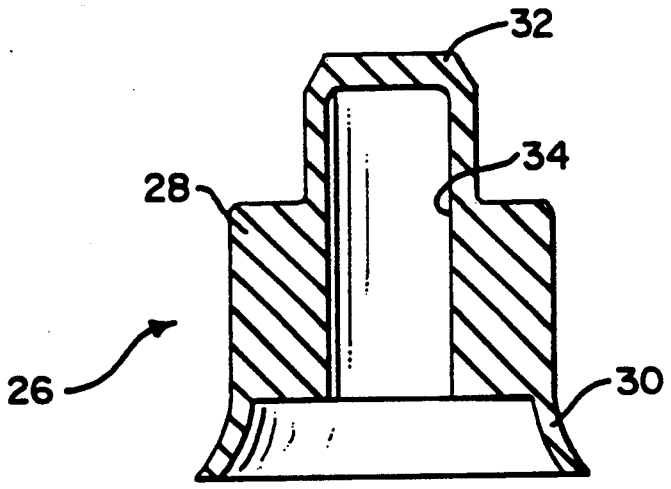
FIG. 3
FIG. 4
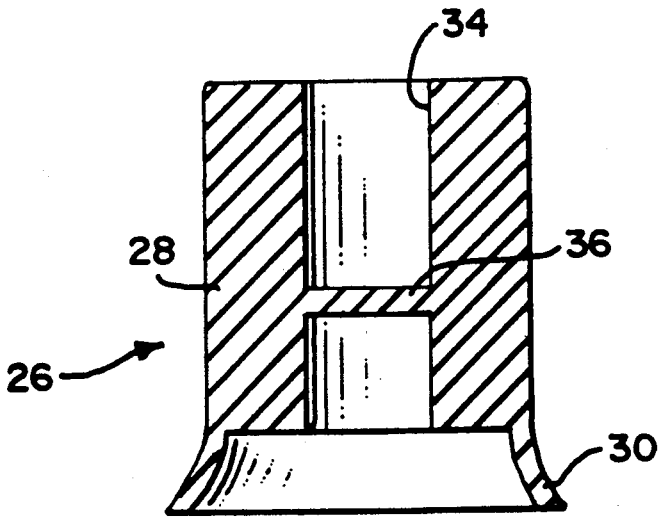

BARRIER PLUG FOR A BORE

BACKGROUND OF THE INVENTION

This invention relates generally to barrier members, and more particularly to a barrier member to prevent the passage of fluid from a first portion of a bore formed in a structure to a second portion, located on the other side of the barrier member. This invention is especially applicable to the restriction of grout to a specific portion of the bore.

In one present system, grout has been used in conjunction with a sleeve to maintain a dynamic rock anchor in a bore. This grout often seeps between the sleeve and the bore. This grout can act as lubrication, permitting the sleeve to be displaced when a rod is inserted into the sleeve.

Also, when the rod is inserted behind the grout, the rod often can force the grout through a hole in the sleeve. If the depth of the bore is limited, then the grout will collect in the upper portion of the bore. This grout will develop hydraulic lock and will prevent the full extension of the rod into the bore.

The foregoing illustrated limitations known to exist in present dynamic rock anchors. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a terrestrial restraint to be inserted into a bore having a bore wall formed in a terrestrial structure. A rod has a first axial segment and a second axial segment, the first axial segment being axially spaced from the second axial segment. Sleeve means engage the first axial segment for securing the first axial segment to a first axial portion of the bore. Hardenable fluid grout means engage the second axial segment for securing the second axial segment to a second axial portion of the bore. Barrier means are inter-spaced between the sleeve means and the fluid grout means for restricting grout passage from the second axial segment to the first axial segment of the bore, the passage of the grout being restricted both prior to and after insertion of the rod into the bore.

The foregoing and other aspects will become apparent from the following detailed description of the invention when considered in conjunction with the accompanying drawing figures.

BRIEF DESCRIPTION OF THE DRAWING FIGURES

FIG. 1 is a cross sectional view illustrating an embodiment of a barrier for a dynamic rock anchor, inserted in a bore, prior to installation of the anchor;

FIG. 2 is a view similar to FIG. 1, following insertion of the dynamic rock anchor;

FIG. 3 is a cross sectional view of the barrier of FIG. 1; and

FIG. 4 is a cross sectional view of an alternate embodiment of barrier.

DETAILED DESCRIPTION

A dynamic rock anchor or rod 10 is inserted into a bore 12. A first section 14 of the rod 10 is attached to a first portion 16 of the bore 12 utilizing grout or fluid 18. It is envisioned that the grout 18 is a resin-hardener based or cement based, but the grout may be of any well known type.

A second section 20 of the rod 10 may be attached to a second portion 22 of the bore 12 utilizing a sleeve 24. The sleeve 24 may be formed from a plastic, elastomeric or other suitable material. A sleeve 24 is not necessary for the instant invention.

A barrier 26 prevents the passage of fluid 18 from the first portion 16 to the second portion 22 of the bore 12. The barrier consists of a tubular portion 28 and an interconnected sealing portion 30. A rupture means 32 is connected to the tubular portion. The barrier may be formed from an resilient material such as plastic, elastomeric or another suitable material which is impervious to the particular fluid being used.

The fluid 18 may be grout contained in a fragmentable bag 19 which bursts upon insertion of the rod 10. However, it is anticipated that this system may be used to prevent passage of any fluid in a bore from passing to undesirable regions, for whatever purposes.

An aperture 34 formed in the tubular portion must have a smaller diameter than the rod or bolt 18. The tubular portion 28 thereby expands to contact the side of the bore 12 when anchor or rod 10 is inserted into the aperture 34. This contact seals against any passage of fluid between the tubular portion and the bore 12.

The sealing portion may be formed as a radial, outwardly flared flange. Prior to insertion of rod 18, the sealing portion 30 contacts the bore to prevent passage of fluid between the sealing portion 30 and the bore 12. In this manner, there is always some restriction against fluid passage between the barrier 26 and the bore 12.

The rupture means 32 may be formed as a cap portion, or a diaphragm 36 formed in the aperture 34. The rupture means 32 is strong enough to resist pressure applied by fluid prior and during insertion of the rod 10, and yet rupture when pressure is directly applied from the rod 10. After the rupture means 32 ruptures, a seal 38 will be formed between the rod and the aperture. In this manner, no fluid will be able to pass through the aperture.

What is claimed is:

1. A barrier means for use in combination with a rod extending into a bore having a cross sectional dimension, formed in a terrestrial structure, the barrier being located on one side of a fluid in the bore, the barrier comprising:

a tubular portion connected to a sealing portion, the tubular portion having a rod passageway formed therethrough, a diameter of the tubular portion being smaller than the cross sectional dimension prior to insertion of the rod, and expanding to conform to the cross sectional dimension in response to insertion of the rod, the rod passageway forming a seal with the rod after insertion of the rod; and rupture means being formed in the tubular portion for sealing the rod passageway to limit a passage of fluid therethrough prior to insertion of the rod, and adapted to rupture in response to penetration by the rod.

2. The barrier as defined in claim 1, further comprising:

the sealing portion adjacent the fluid has a flexible flange in sealing contact with the bore.

3. The barrier as defined in claim 1, wherein the tubular portion comprises:

a sleeve means for connecting the rod to a portion of the bore.

4. A terrestrial restraint to be inserted into a bore having a bore wall formed in a terrestrial structure comprising:

a rod having a first axial segment and a second axial segment, the first axial segment being axially spaced from the second axial segment;

sleeve means engaging the first axial segment, for securing the first axial segment to a first axial portion of the bore;

hardenable fluid grout means engaging the second axial segment for securing the second axial segment to a second axial portion of the bore;

barrier means inter-spaced between the sleeve means and the fluid grout means for restricting grout passage from the second axial segment to the first axial segment of the bore, the passage of grout being restricted both prior to and after insertion of the rod into the bore.

5. The restraint as described in claim 4, wherein the barrier means comprises:

a flange mounted circumferentially of said barrier means, an outer periphery of which engages the bore wall.

6. The restraint as described in claim 4, wherein the barrier means includes a body portion which, when inserted into the bore, is axially aligned therewith;

7. The restraint as described in claim 6, wherein the cross section of the body portion is a first dimension prior to said rod insertion and a second dimension after said rod insertion, said first dimension being less than a diameter of the bore wall, and the second dimension being greater or equal to the diameter of the bore wall.

8. The restraint as described in claim 6, wherein the body portion includes an aperture having an aperture wall formed therein which, after the rod insertion forms a seal between the rod and the aperture wall.

9. The restraint as described in claim 6, further comprising:

an aperture formed in the body portion; and rupture means, proximally located to the aperture, for preventing grout passage through the aperture prior to said rod insertion.

10. The restraint as described in claim 9, wherein the rupture means comprises:

a cap portion which is mounted on a face of the body portion adjacent the first axial portion.

11. The restraint as described in claim 9, wherein the rupture means comprises:

a diaphragm disposed within the aperture.

12. The restraint as described in claim 4, wherein the grout is a resin-hardener mixture.

13. The restraint as described in claim 4, wherein the grout is a cement.

14. A barrier plug for insertion into a bore formed in a terrestrial structure for restricting passage of a grout from a first portion to a second axial separated portion of the bore, the barrier plug comprising:

a body portion having an axially extending aperture located within the body portion permitting insertion of a rod therethrough, said aperture being formed by an aperture wall, after said rod insertion, forms a seal between the aperture wall and the rod;

rupture means for preventing grout passage through the aperture prior to said rod insertion, and adapted to be ruptured by the rod insertion; and seal means for preventing grout passage between the body portion and the bore both prior to and after the rod insertion.

15. The plug as described in claim 14, wherein the seal means comprises:

a flange mounted circumferentially of the body portion, an outer periphery of which engages a bore wall which forms the bore.

16. The plug as described in claim 14, wherein a cross section of the body portion is a first dimension prior to said rod insertion and a second dimension after said rod insertion, said first dimension being less than a diameter of the bore wall, the second dimension being greater or equal to the diameter of the bore wall.

17. The plug as described in claim 14, wherein the rupture means comprises:

a cap portion which is mounted on a face of the body portion adjacent the first axial portion.

18. The plug as described in claim 14, wherein the rupture means comprises:

a diaphragm disposed within the aperture.

19. The restraint as described in claim 14, wherein the grout is a resin-hardener mixture.

20. The restraint as described in clam 14, wherein the grout is a cement.

* * * * *